US005251585A

United States Patent [19]

Gräber

[11] Patent Number: 5,251,585

[45] Date of Patent: Oct. 12, 1993

[54] TWO-ARMED LEVER

[75] Inventor: Andreas Gräber, Offenburg, Fed. Rep. of Germany

[73] Assignee: Erich Neumayer GmbH & Co. K.G., Hausach, Fed. Rep. of Germany

[21] Appl. No.: 12,001

[22] Filed: Feb. 1, 1993

[30] Foreign Application Priority Data

Feb. 12, 1992 [DE] Fed. Rep. of Germany ..... 4204030

[51] Int. Cl.[5] ..... F01L 1/18

[52] U.S. Cl. ..... 123/90.39; 123/90.41; 123/90.43; 74/519; 74/559

[58] Field of Search ..... 123/90.39, 90.4, 90.41, 123/90.42, 90.44, 90.45, 90.47; 74/519, 559

[56] References Cited

U.S. PATENT DOCUMENTS

| | | | |
|---|---|---|---|
| 2,199,914 | 5/1940 | Haberstump | 74/519 |
| 3,096,749 | 7/1963 | Davidson | 74/519 |
| 4,762,096 | 8/1988 | Kamm et al. | 123/90.43 |
| 4,825,717 | 5/1989 | Mills | 123/90.39 |
| 4,995,281 | 2/1991 | Allor et al. | 123/90.44 |
| 5,016,582 | 5/1991 | Mills | 123/90.39 |
| 5,048,475 | 9/1991 | Mills | 123/90.39 |
| 5,060,606 | 10/1991 | Hubbard | 123/90.39 |
| 5,074,261 | 12/1991 | Hamburg et al. | 123/90.39 |

*Primary Examiner*—E. Rollins Cross
*Assistant Examiner*—Weilun Lo
*Attorney, Agent, or Firm*—Peter K. Kontler

[57] ABSTRACT

A two-armed lever which can be used as a rocker arm in the valve mechanism of a combustion engine has a central portion defining a rectangular passage for reception of a cam-actuated bearing on the rocker arm shaft. The first arm of the lever has a cupped motion receiving first portion which receives the complementary head of a push rod, and a second portion having an H-shaped cross-sectional outline and located between the cupped portion and the walls surrounding the passage in the central portion of the lever. The other arm of the lever has a first portion provided with an arcuate surface serving to transmit motion to the shank of an exhaust valve, and a second portion having an H-shaped cross-sectional outline and disposed between the first portion of the second lever and the walls surrounding the passage. The lever can be made by converting (by heating and extrusion or by drop forging) a block-shaped blank of steel into a second blank which is thereupon cold formed to more closely resemble or to constitute the lever.

7 Claims, 2 Drawing Sheets

TWO-ARMED LEVER

BACKGROUND OF THE INVENTION

The invention relates to improvements in levers in general, and more particularly to improvements in pivotable levers which can be used as rocker arms in valve mechanisms of motor vehicles. The invention also relates to improvements in methods of making rocker arms.

A rocker arm can be used in a combustion engine to be pivoted near the center and operated by a pushrod or other motion transmitting means at one end in order to raise or depress the stem of a valve normally engaged by the other end. As a rule, or at least in many instances, the median or central portion of the rocker arm is provided with a passage which extends transversely of the two arms of the rocker arm (in the direction of pivoting) and serves to receive a bearing or another device which can be actuated by a cam.

A drawback of presently known levers which are used as rocker arms in the valve mechanisms of combustion engines is their high cost and insufficient stability.

OBJECTS OF THE INVENTION

An object of the invention is to provide a pivotable lever which can be utilized as a rocker arm in a combustion engine and is stronger than heretofore known rocker arms.

Another object of the invention is to provide a rocker arm with novel and improved motion receiving and motion transmitting arms.

A further object of the invention is to provide a novel and improved a compact rocker arm.

An additional object of the invention is to provide a novel and improved method of making rocker arms.

Still another object of the invention is to provide a simple and inexpensive method of making high-quality rocker arms.

SUMMARY OF THE INVENTION

One feature of the present invention resides in the provision of a pivotable lever which can be utilized with particular advantage as a rocker arm for actuation of a valve in an internal combustion engine. The improved lever comprises a first arm, a second arm and a central or median portion disposed between the arms and having a passage extending substantially transversely of the arms and serving to receive a cam-operated device (e.g., an antifriction bearing). The median portion of the lever has walls which completely surround the passage, and the first arm includes a motion receiving first portion and a second portion having a substantially H-shaped cross-sectional outline and disposed between the first portion and the walls of the median portion. The second arm includes a first portion which can be used to transmit motion to a shank of a valve in a motor vehicle, and a second portion having a substantially H-shaped cross-sectional outline and disposed between the walls of the median portion and the first portion of the second arm.

The first portion of the first arm can include a substantially concave socket, e.g., for one end of a push rod, and the first portion of the second arm can be provided with an arcuate surface which extends in a direction toward the median portion and is movable into rolling engagement with a substantially complementary surface of a shank. The socket and the arcuate surface can be disposed at one and the same side of the lever.

The walls which surround the passage are provided with a bore or hole for reception of a shaft (such as a rocker arm shaft), and this hole extends transversely of and communicates with the passage.

The second portion of each arm comprises a web which can extend substantially transversely of and is separated from the passage by a portion of the walls surrounding the passage. The latter can have a substantially rectangular cross-sectional outline.

Another feature of the present invention resides in the provision of a method of converting a first blank of metallic material into a pivotable lever of the above outlined character. The method can comprise the steps of heating the first blank, extruding the heated first blank to convert such first blank into a second blank more closely resembling the finished product, and cold forming the second blank to convert such second blank into a third blank even more closely resembling the lever. The cold forming step can include extruding the second blank, and the method can further comprise the step of calibrating the third blank subsequent to the cold forming step, i.e., irrespective of whether or not the cold forming step is an extruding step.

The method can be modified in the following way: The first step can include drop forging the first blank to convert it into the second blank. The next-following step or steps (cold forming and, if necessary, calibrating) can be the same as described above.

The novel features which are considered as characteristic of the invention are set forth in particular in the appended claims. The improved lever itself, however, both as to its construction and the mode of making the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
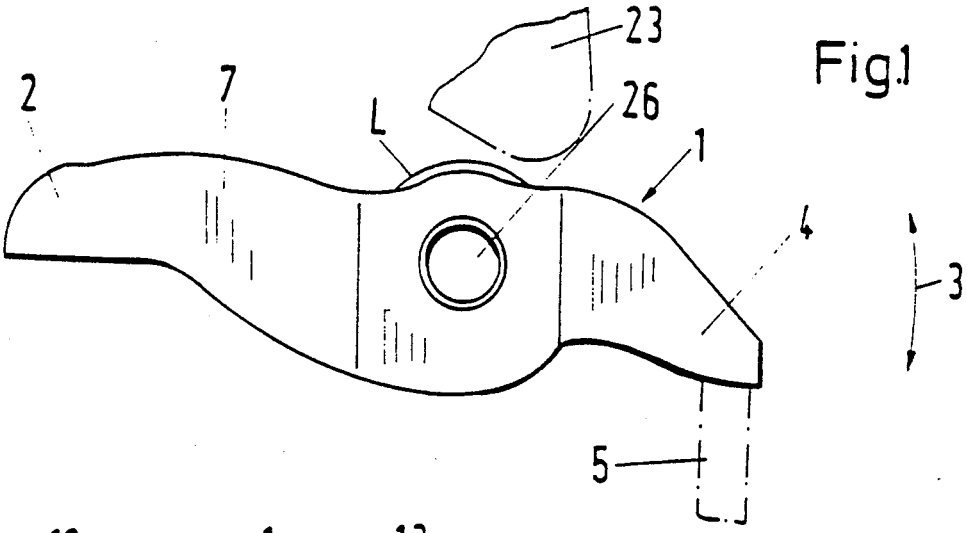
FIG. 1 is a side elevational view of a lever which embodies the invention.
Figure 3:
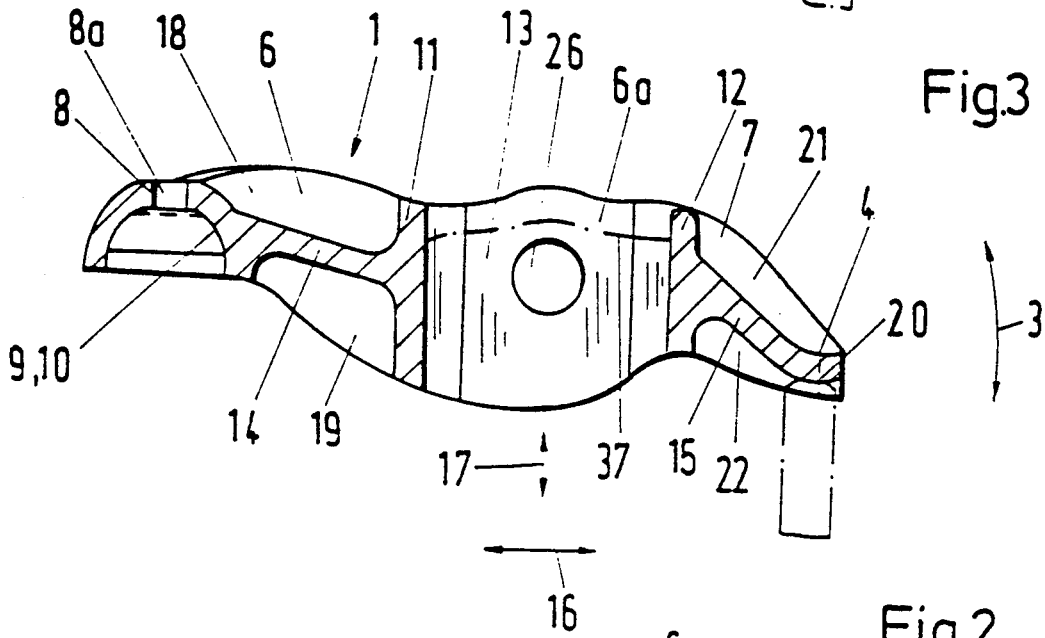
FIG. 3 is a sectional view substantially as seen in the direction of arrows from the line III—III in FIG. 2.
Figure 2:
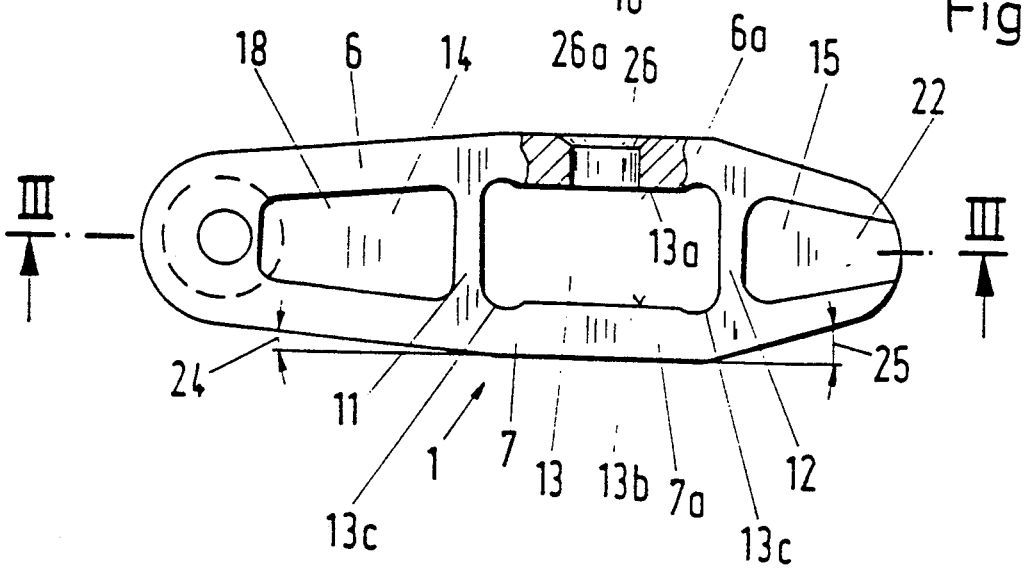
FIG. 2 is a plan view of the lever which is shown in FIG. 1, with a portion of one wall surrounding the passage of the median portion of the lever broken away.

The lever 1 which is shown in FIGS. 1 to 3 can be used as a rocker arm in the valve mechanism of an internal combustion engine. This lever has a first arm 2 and a second arm 4 and is pivotable about an axis defined by a rocker arm shaft (not shown) extending through a transverse bore or hole 26 when the lever is used as a rocker arm. The directions of pivotal movement of the lever 1 are indicated by a double-headed arrow 3. A first portion of the first arm 2 can receive motion from a push rod (not shown) having a head extending into a concave socket 10 in the first portion of the arm 2 when the lever 1 is put to use as a rocker arm. An arcuate surface 20 on a first portion of the second arm 4 can transmit motion to a shank 5 (indicated by phantom lines) of an exhaust valve in an internal combustion engine.

The lever 1 comprises two longitudinally extending lateral wall members 6 and 7 which flank a centrally located passage 13 having a substantially rectangular outline, extending in the direction of arrow 3 and communicating with the two halves of the bore or hole 26 which are provided in the wall members 6 and 7. Those end portions of the wall members 6, 7 which form part of the arm 2 merge into a cupped end portion 8 which has an internal surface 9 bounding the concave socket 10 for the head of a push rod. The cupped end portion 8 has a bore or hole 8*a* which affords access to or accommodates a portion of an adjusting screw (not shown) which serves to select the play between the first end of the arm 4 and the shank 5. The head of the aforementioned push rod is preferably provided with a convex surface which is complementary or substantially complementary to the surface 9 bounding the concave socket 10 in the first portion of the arm 2. The head of the push rod and the cupped end portion 8 roll relative to each other when the push rod is active to pivot the lever 1 about the axis defined by a rocker arm shaft in the bore or hole 26.

The longitudinally extending lateral wall members 6, 7 of the lever 1 are connected to each other by transversely extending walls 11, 12 forming part of a set of four walls 6*a*, 7*a* 11, 12 which completely surround the passage 13 in the median or central portion of the lever 1 between the arms 2 and 4. The walls 11, 12 are substantially normal to the wall members 6, 7 and are or can be substantially parallel to one another (see particularly FIG. 3). The passage 13 is further bounded by wall portions or walls 6*a*, 7*a* respectively forming part of the wall members 6, 7 and extending between the transverse walls 11, 12.

The arrow 16 indicates the longitudinal direction of the lever and such direction is normal or nearly normal to the direction of the passage 13 (arrow 17 in FIG. 3).

The wall members 6, 7 are further connected to each other by walls or ribs 14 and 15. The rib 14 forms part of a second portion of the arm 2 and extends to the wall 11 adjacent the passage 13. This second portion of the arm 2 has a substantially H-shaped cross-sectional outline (FIG. 3) and includes the rib 14 as well as the adjacent portions of the wall members 6, 7. Analogously, the rib 15 extends between the wall members 6, 7 between the central portion of the lever 1 (and more specifically the wall 12) and the first end of the arm 4. The second portion of the second arm 4 has an H-shaped cross-sectional outline and is adjacent the arcuate surface 20 on the first portion of the second arm 4. Each of the two ribs 14, 15 extends substantially longitudinally of the lever (as indicated by the arrow 16) as well as transversely all the way between the wall members 6 and 7. The rib 14 is flanked by two recesses 18, 19 in the second portion of the first arm 2, and the rib 15 is flanged by two recesses 21, 22 in the second portion of the arm 4.

The aforementioned arcuate surface 20 is provided directly on the rib 15 because the arm 4 of the lever 1 does not have an equivalent of the domed or cupped end portion 8 forming part of the arm 2. The arcuate surface 20 is a spherical convex surface or simply a convex surface and extends in the direction of the arrow 16. It will be noted that the concave surface 10 on the first portion of the arm 2 and the convex surface 20 on the first portion of the arm 4 are disposed at one and the same side of the lever 1.

The character 23 denotes in FIG. 1 a cam which can serve to operate a device L (e.g., an antifriction ball or roller bearing) which extends into the passage 13 and is accessible at the other side of the lever 1 opposite the convex socket 10 and arcuate surface 20. The bearing L can be mounted on the aforementioned rocker arm shaft when such shaft is installed to extend into or through the bore or hole 26.

Those portions of the lateral wall members 6, 7 which extend from the transverse wall 11 to the cupped end portion 8 converge toward each other (see the angle 24 in FIG. 2), the same as those portions of the wall members 6, 7 which extend from the transverse wall 12 to the surface 20 on the rib 15 (see the angle 25 in FIG. 2). The acute angle 24 between those portions of the wall members 6, 7 which flank the rib 14 is smaller than the acute angle 25 between those portions of the wall members 6, 7 which flank the rib 15.

The rocker arm shaft in the bore or hole 26 can constitute a pin made of steel or another suitable material and carrying the aforementioned cam-operated device L. It will be noted that a very large part (nearly the entire part) of the device L is installed in the passage 13.

The aforedescribed design imparts to the lever 1 a very pronounced stability. In addition, such lever can be mass produced in a simple and economical operation by resorting to the steps of a method which will be described with reference to FIGS. 4 and 5.

One starts with a first blank which can constitute a substantially block-shaped piece of steel, such as an alloy known as 25 Cr Mo 4. The first blank is placed into a drop forging tool and is converted, by drop forging or by extrusion in the presence of heat, into a second blank such as the one shown at 34 in FIGS. 4 and 5. The second blank 34 is turned through 180° relative to the position of the lever 1 in FIG. 3, namely about an axis which is normal to the axis of the composite bore or hole 26 and is located in the plane of FIG. 3. It will be seen that the second blank 34 resembles the finished lever 1 of FIG. 3, certainly much more than the non-illustrated first blank which, as stated above, can constitute a simple block of steel or another suitable alloy. FIG. 5 shows the second blank 34 of FIG. 4 in a view as seen in the direction of arrow 30 in FIG. 4.

Figure 4:
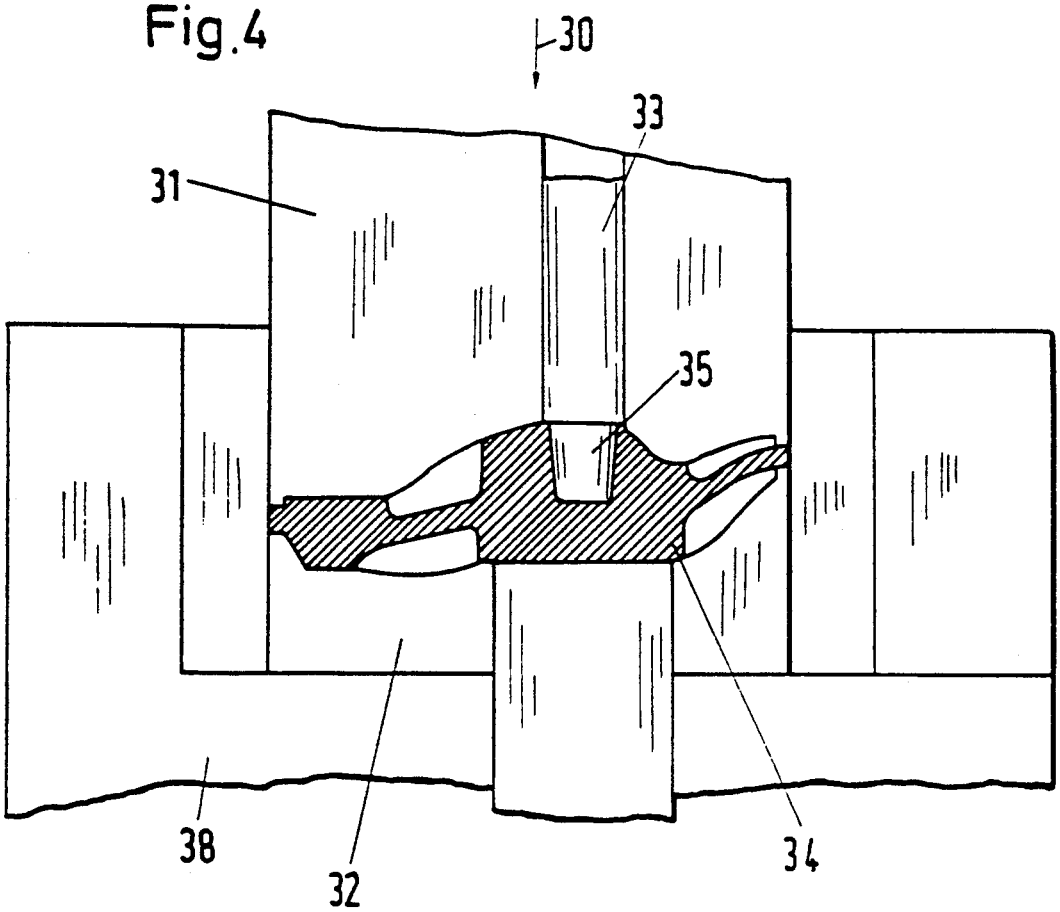
FIG. 4 is a fragmentary elevational view of a portion of an apparatus which can be utilized for the practice of a method of making levers of the type shown in FIGS. 1 to 3, a second blank being shown in a sectional view corresponding to that of FIG. 3.
Figure 5:
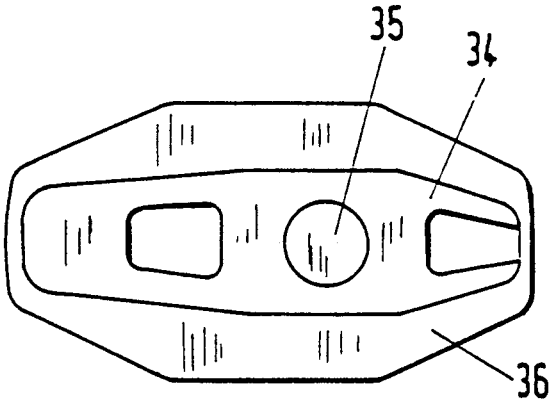
FIG. 5 is a plan view of the blank which is shown in FIG. 4.

The drop forging or extruding tool which is shown in FIG. 4 comprises a ram 31 and a female component or base 38 with an inserted anvil 32. The ram 31 contains a reciprocable shaping tool 33 having a frustoconical or similarly configurated tip which is in the process of starting to shape (at 35) the passage 13. The initial stage of making the passage 13 involves the formation of a recess 35 in that side of the second blank 34 which faces upwardly, as viewed in FIG. 4, and is acted upon by the ram 31. FIG. 4 further shows that the ram 31 cooperates with the insert or anvil 32 to provide the second blank 34 with recessed and projecting portions which constitute the ribs 14, 15 and the recesses 18, 19 and 21, 22 of the finished lever 1.

FIG. 5 shows that the second blank 34 further comprises a circumferentially complete marginal portion 36. Such marginal portion is obtained as a result of properly controlling the stroke of the ram 31 in a direction toward the insert or anvil 32 in the base 38. The just described treatment of the first blank to form the second blank 34 is deemed desirable and advantageous for the purpose of ensuring more satisfactory flow of metallic material which forms the first blank while the first blank is being converted into the second blank 34.

When the shaping of the second blank 34 is completed, it is transferred into a cold forming tool (not shown) wherein the conversion proceeds, i.e., the blank 34 is converted into a third blank (not specifically shown) which constitutes or at least closely resembles the lever 1 of FIG. 3. At any rate, the resemblance is much greater than between the lever 1 and the second blank 34 of FIGS. 4 and 5. The third blank can be identical or practically identical with the lever 1 of FIG. 3 with the possible exception that it still comprises a closure or end wall (indicated in FIG. 3 by a phantom line 37) at one end of the passage 13.

The treatment of the third blank can involve removal of the end wall 37 (e.g., by stamping or pressing) and the removal or shaping of the circumferentially complete marginal portion 36 which is shown in FIGS. 4 and 5. For example, the marginal portion 36 can be removed by punching or stamping. If necessary, the just outlined treatments of the third blank can be followed by, or can take place simultaneously with, stamping to calibrate the more important portions of the lever 1, i.e., those portions whose dimensions and shape must match or very closely approximate an optimum value.

It is often desirable to subject the heat treated first blank (i.e., the second blank 34) to a suitable radiation treatment in order to remove scale (if any) prior to start of the cold forming operation which results in conversion of the blank 34 into the aforediscussed third blank or directly into the lever 1. The radiation treatment can be followed by annealing. It is also possible to bonderize the second blank prior to cold treatment; this can involve the application of a coat of lubricant or another friction reducing agent to facilitate conversion of the second blank into a third blank in the course of the cold forming operation. For example, the second blank can be coated with a layer of phosphate as well as with a layer of lubricant. The phosphate layer exhibits a desirable roughness which ensure desirable adherence of the lubricating agent.

The bonderizing agent or agents are preferably removed upon completion of the cold forming step, i.e, prior to the aforediscussed stamping and calibrating steps (if necessary). If a stamping and/or calibrating treatment is necessary or desirable, it can be preceded (if necessary) by annealing and by renewed application of lubricating and/or other friction reducing agents. The last stage (following the calibration) can involve a cleaning and debonderizing of the finished or nearly finished lever.

Removal of the end wall 37 and/or of the marginal portion 36 can be followed by mechanical (e.g., rubbing or brushing) treatment or by a material removing treatment (e.g., polishing, grinding and/or breaching) in a machine tool. This can involve the making of the transverse bore or hole 26 and the provision of outwardly flaring surfaces 26*a* (FIG. 2) at the outer ends of the two halves of the bore or hole 26. Still further, the treatment in a material removing machine can involve finishing the surfaces 13*a* and 13*b* bounding those portions of the passage 13 which are adjacent the wall member portions 6*a* and 7*a*. If a finishing of the surfaces 13*a*, 13*b* is desirable or necessary, the aforediscussed cold forming and stamping operations are carried out in such a way that the walls 6*a*, 7*a* contain a surplus of material which is to be removed during finishing of the surfaces 13*a*, 13*b*. FIG. 2 shows that the ends of the surfaces 13*a*, 13*b* are adjacent shallow recesses 13*c* which are desirable and advantageous because they enable a machine tool to more accurately finish the surfaces 13*a*, 13*b*. The machine tool can be used for the additional purpose of drilling the hole 8*a* in the cupped end portion 8 of the arm 2.

The material removing treatment of the lever 1 (such as is necessary to form the holes 8*a*, 26 and/or to finish the surfaces 13*a*, 13*b*) can be preceded by a trowalizing or radiation treatment for the purpose of removing scale (if any) and to round the edges (if necessary) as well as to clean certain surfaces (again, if necessary). However, the just discussed trowalizing or radiation treatment can constitute the last stage of making of the lever 1, i.e., it can follow the material removing operations.

In accordance with a further modification of the improved method of making the lever 1, the end wall 37 which is shown in FIG. 3 at the side opposite the side for the socket 10 and the arcuate surface 20 can be provided at the other end of the passage 13. This exhibits the advantage that such end wall can be removed in the course of the cold forming or calibrating step. This, in turn, exhibits the additional advantage that the surfaces 13*a*, 13*b* can be adequately finished without resorting to a material removing operation, i.e., they can be imparted their final shape during cold forming and/or during calibrating. This is due to the fact that, if the end wall 37 is provided at the other end of the passage 13 (namely at the lower end as seen in FIG. 3), it can be removed without affecting the quality of those portions of the surfaces 13*a* and 13*b* which are necessary for proper installation of the cam-operated device L. In fact, it is even possible to leave the end wall 37 on the finished lever 1 if such end wall is provided in the lower end of the passage 13 (as viewed in FIG. 3). At most, such end wall will have to be formed with one or more outlets for the flow of lubricant from the channel or passage 13 (which is otherwise closed and sealed at its lower end (again as seen in FIG. 3).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A pivotable lever, particularly a rocker arm for actuation of a valve in a combustion engine, comprising a first arm; a second arm; and a median portion disposed between said arms and having a passage extending substantially transversely of said arms and arranged to receive a cam-actuated device, said median portion having walls completely surrounding said passage, said first arm including a motion receiving first portion and a second portion having a substantially H-shaped cross-sectional outline and disposed between said first portion and said walls, said second arm including a first portion arranged to transmit motion to a shank of a valve and a second portion having a substantially H-shaped cross-sectional outline and disposed between said walls and the first portion of said second arm.

2. The lever of claim 1, wherein said first portion of said first arm includes a substantially concave socket.

3. The lever of claim 1, wherein said first portion of said second arm has an arcuate surface movable into engagement with a substantially complementary surface of a shank.

4. The lever of claim 3 having a first side and a second side, wherein said arcuate surface is disposed at said first side, and said first portion of said first arm includes a substantially concave socket at said first side.

5. The lever of claim 1, wherein said walls have a hole for reception of a shaft, said hole extending transversely of and communicating with said passage.

6. The lever of claim 1, wherein each of said second portions includes a rib, said ribs being spaced apart from each other, and said passage being disposed between said ribs.

7. The lever of claim 1, wherein said passage has a substantially rectangular cross-sectional outline.

* * * * *